United States Patent [19]

Thompson

[11] 4,300,581

[45] Nov. 17, 1981

[54] CENTRIFUGAL WAFER PROCESSOR

[76] Inventor: Raymon F. Thompson, 137 Sherry La., Kalispell, Mont. 59901

[21] Appl. No.: 127,660

[22] Filed: Mar. 6, 1980

[51] Int. Cl.[3] ..... B08B 3/02

[52] U.S. Cl. ..... 134/57 R; 134/140; 134/153; 134/155; 134/200; 156/345

[58] Field of Search ..... 134/57 R, 140, 149, 134/153, 155, 158, 159, 165, 200; 156/345

[56] References Cited

U.S. PATENT DOCUMENTS

| | | | |
|---|---|---|---|
| 2,225,501 | 12/1940 | Lapham et al. | 134/149 X |
| 2,684,585 | 7/1954 | Smith | 134/158 X |
| 3,383,255 | 5/1968 | Rossi et al. | 156/345 X |
| 3,464,429 | 9/1969 | Ehrhardt | 134/140 |
| 3,489,608 | 1/1970 | Jacobs et al. | 134/149 X |
| 3,760,822 | 9/1973 | Evans | 134/140 X |
| 3,808,065 | 4/1974 | Robinson et al. | 156/345 X |
| 3,964,957 | 6/1976 | Walsh | 134/159 X |
| 3,970,471 | 7/1976 | Bankes et al. | 134/80 X |
| 4,077,416 | 3/1978 | Johnson, Jr. et al. | 134/159 |

FOREIGN PATENT DOCUMENTS

| | | | |
|---|---|---|---|
| 1477965 | 6/1969 | Fed. Rep. of Germany | 134/153 |

OTHER PUBLICATIONS

Mathisen; IBM Tech. Disclosure Bulletin, vol. 10, No. 3 8/67; Etch Control Probe, pp. 193 & 194.

*Primary Examiner*—Robert L. Bleutge
*Attorney, Agent, or Firm*—H. Kenneth Johnston, II; Donald W. Margolis

[57] ABSTRACT

An automatic production apparatus for processing semiconductor wafers which include a rotor rotatable about a substantially horizontal axis where the rotor includes a removable carrier capable of holding a plurality of semiconductor wafers or glass photomask plates and a plastic-coated bar for retaining the semiconductor wafers in the carrier when inverted at low RPM's and a plurality of spray nozzles for providing the processing medium and a recessed drain for removing the expended processing medium. A timing device sequentially controls the processing functions and structure is provided to accomplish these functions.

24 Claims, 4 Drawing Figures

CENTRIFUGAL WAFER PROCESSOR

BACKGROUND OF THE INVENTION

This invention relates to an apparatus for processing semiconductor wafers or glass photomask plates, and more particularly, to improve machine operated functions improving the processing yield of semiconductor wafers. In the production of integrated circuits, the semiconductor wafers or substrates from which the chips are cut, are processed through multiple steps. The basic material for the substrates on the wafers may be silicon, glass, or ceramic materials of various sorts or other similar materials of very thin wafer-like configuration. This basic substrate is subjected to coating, etching, and cleaning processes and it is extremely important that each processing step is performed with the greatest possible yield allowing a decrease in production costs.

Semiconductor wafers and glass photomask plates in the past have been processed by spinning them about a vertical axis where the wafers or masks are stacked vertically as described in U.S. Pat. No. 3,760,822 with various holding mechanisms such as vacuum chucks. This has led to further disadvantages where the wafer may be only processed on one side at a time without a significantly different processing rate, wherein the topside processes at a much faster rate than that of the underside.

Other processing devices such as described in U.S. Pat. No. 3,970,471, process each wafer individually. Although the wafer is rotated about a horizontal axis, such a device only can process a single wafer at each station and is expensive and time consuming.

The present invention permits the processing of a plurality of wafers at the same time and, because of the substantially horizontal axis of rotation, each side of the wafer is processed at effectively the same rate. The axis of rotation is not exactly horizontal, as if it were, the wafers could lay in the carrier in a manner that might permit touching of each other which might allow a miniscus to form between two wafers which, because of the surface tension, would prohibit proper processing and reduce the yield of good semiconductor wafers.

SUMMARY OF THE INVENTION

In accordance with this invention, semiconductor wafers or glass photomask plates are processed by inserting into the carrier and placing the carrier in the rotor which rotates around a substantially horizontal axis. Various fluids are applied to the wafers uniformly through the spray nozzles while the wafers are being rotated. Chemical processing such as etching is performed to both sides at the same rate due to the substantially horizontal axis of rotation. The spray nozzles are located above and to the side of the carrier permitting the processing to be done at low pressures. This is extremely beneficial when hazardous materials are used in the process steps. The spray nozzles being to the side of the carrier is further beneficial wherein it eliminates the possibility of a leaking nozzle from dripping on a wafer or mask during the drying process and potentially ruining good semiconductor wafers or glass photomask plates.

Loading of the carrier into the rotor is further simplified because of the horizontal loading unlike that of a vertical load system.

There are built-in shock absorbers so that any vibration from the spinning action is not transferred to the work station.

BRIEF DESCRIPTION OF THE DRAWING

The aforementioned and other features, characteristics and advantages, and the invention in general will be better understood from the following description taken in conjunction with the accompanying drawings.

DESCRIPTION OF THE INVENTION

Figure 1:
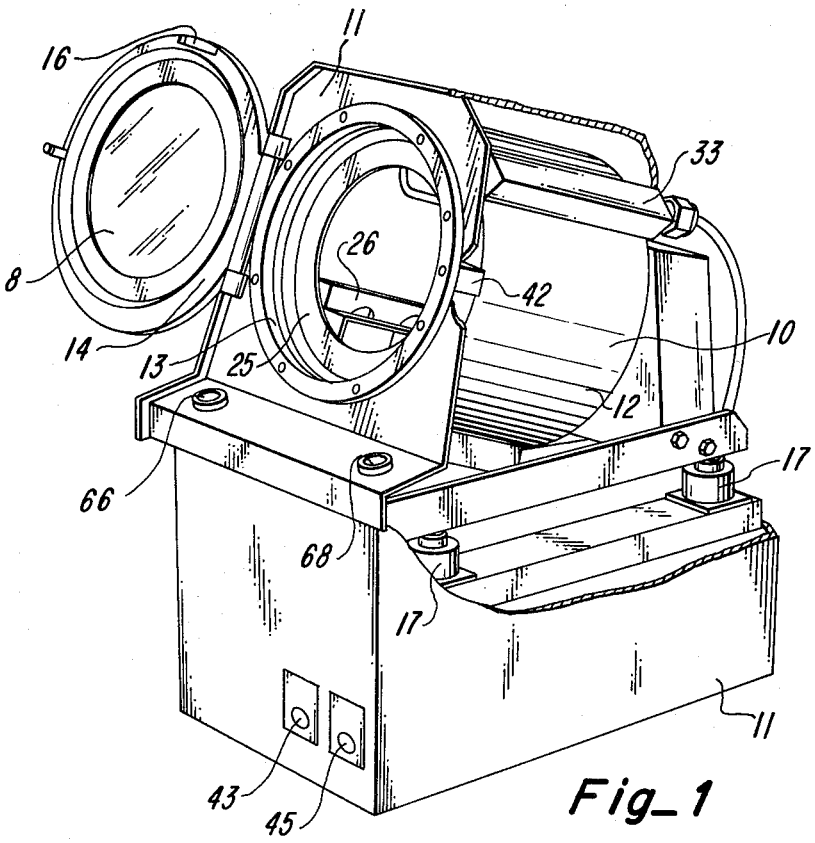
FIG. 1, which is a perspective representation of the organization and some details of the apparatus of the present invention.
Figure 3:
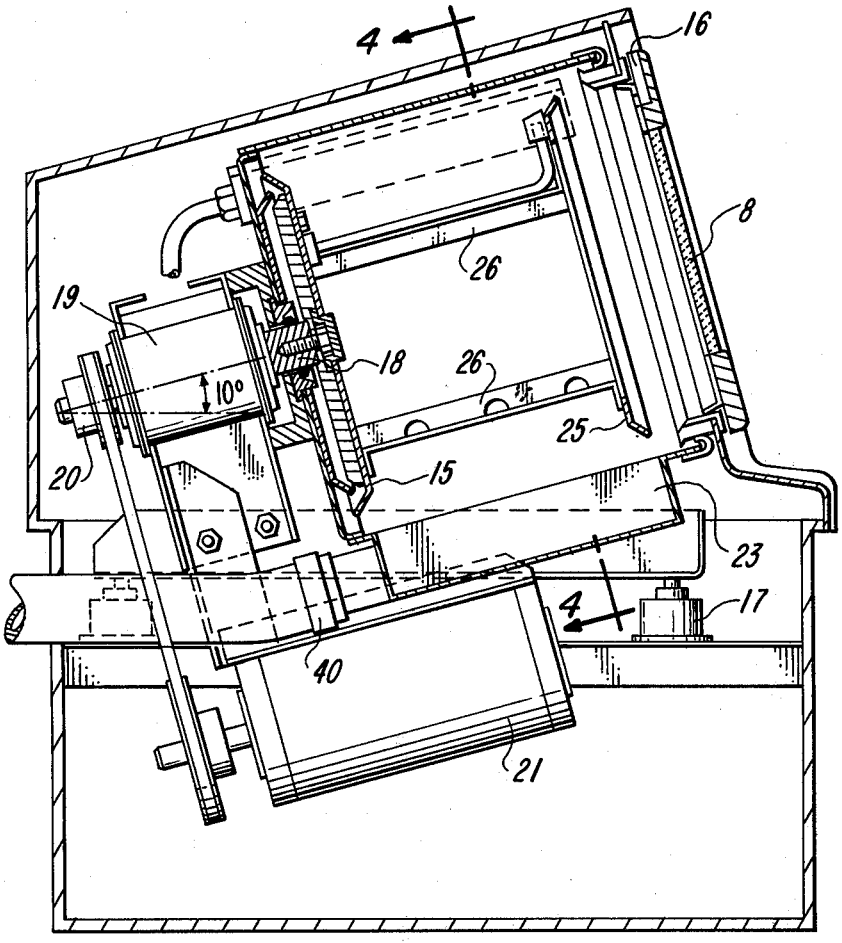
FIG. 3, which is a cross-section view and schematic representation of the washing apparatus.
Figure 4:
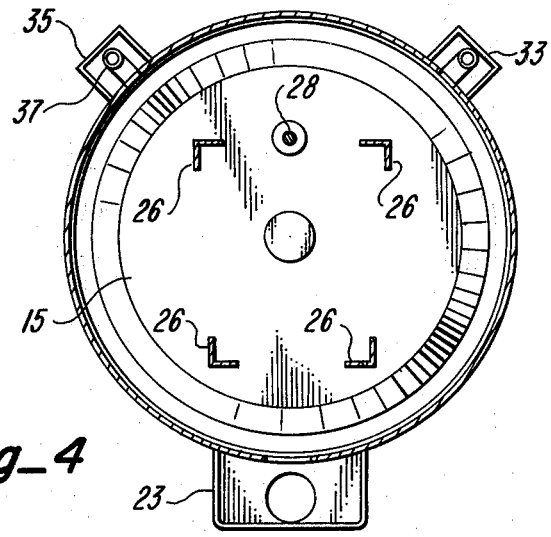
FIG. 4, which is a cross-section view taken along line 4—4 of FIG. 3.

Referring now to the drawings, an apparatus 10 for processing wafer or semiconductor components is illustrated in FIG. 1. The apparatus of the present invention includes some common components and functional relationships to existing front loading household washing machines which will be apparent from the discussion which follows. The apparatus 10 as shown in FIG. 1 has a somewhat rectangular outer configuration and a front opening. This style of apparatus is sometimes referred to as a front-loading machine indicative of the loading position. The apparatus 10 includes a frame and cabinet assembly 11 which houses a stationary tub 12 with a front opening 13. A hinged door 14 on the frame is arranged to seal with respect to the tub opening 13 so that the tub and door provide an enclosed fluid processing chamber. Tub 12 is constructed of corrosion and solvent resistent material such as stainless steel. The tub 12 is a cylindrically shaped container with recessed drain 23 at the bottom for the easy removal of processing fluids during the processing cycles. Concentrically arranged within tub 12 is rotor 15 having support members 26, support rod 28, and support ring 25. Rotor 15 is supported within tub 12 for rotation by means of central axle 18 FIG. 3 which is sealingly received by and rotatively supported by bearing 19. The center axis for bearing 19 is the axis for ratoation for rotor 15. A pulley and belt connection 20 external to tub 12 couples axle 18 to an electrically driven motor 21. This motor 21 provides a driving means for rotating rotor 15 within tub 12. Tub 12 is essentially stationary and connected to the frame 11 and is vibrationally supported by shock absorbers 17. With the tub 12, there is provided a plurality of spray members 33 and 35 which are above and parallel to support members 26 of rotor 15, as shown in FIG. 4. Support member 26 and support rod 28 are coupled to support ring 25 as shown in FIG. 2, providing the outer support for carrier 38.

Figure 2:
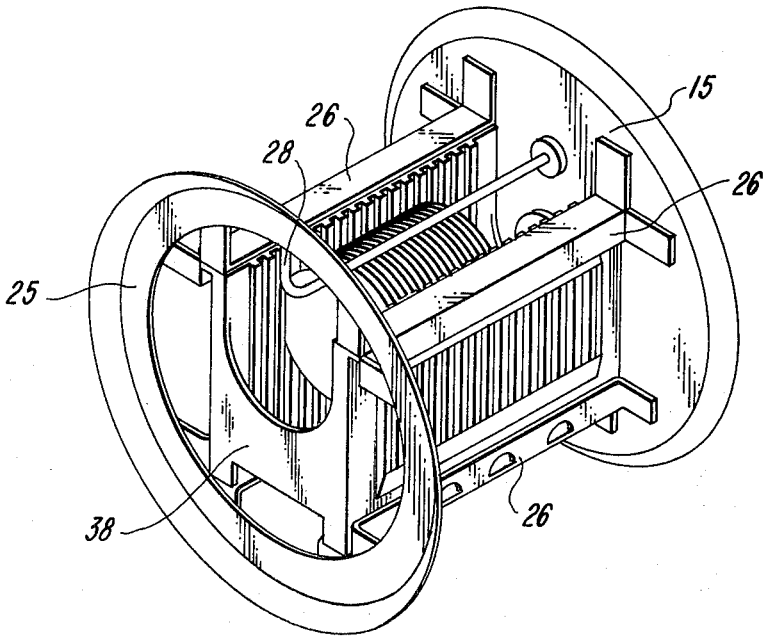
FIG. 2, which is an enlarged perspective representation partially broken away of the rotor, carrier, and spray nozzle apparatus.

In the practice of the present invention, semiconductor wafers in carrier 38 are placed in support members 26 of rotor 15 as shown in FIG. 2. Support rod 28, as shown in FIG. 2, retains the semiconductor wafers in carrier 38 when rotor 15 is revolving at reltively low RPM's. As the speed of rotation of rotor 15 increases, the semiconductor wafers are held in place by centrifugal force. The semiconductor wafers are processed by the application of various fluids through spray members 33 and 35. Rotor 15 rotates substantially around a horizontal axis; however it is necessary that the angle of the axis of rotation of rotor 15 be greater or lesser than exactly horizontal to prevent the semiconductor wafers from contacting each other during processing. If the semiconductor wafers or masks contact each other during processing, a surface tension may be formed which would prevent processing of the semiconductor wafers or masks in the area of contact with each other resulting in a lower yield. It is extremely important that rotor 15 has an angle of rotation greater or less than exactly horizontal. In the preferred embodiment the angle of the axis of rotation is more or less 10° above horizontal as shown in FIG. 3. This adds to the ease of loading of the semiconductor wafers and as a result of the angle, carrier 38 easily slides into support members 26 without the requirement of a retaining device to prohibit carrier 38 from falling out of apparatus 10. The high rate rotation of the semiconductor wafers by rotor 15 allows the pressure of the processing fluids applied by spray members 33 and 35 to be low and therefore saving extensive costs in the elimination of high pressure equipment. Spray members 33 and 35 in the preferred embodiment separately carry the processing fluids and nitrogen to permit safe optimum performance. During operation, the semiconductor wafer may be observed through window 18 of door 14. During the processing steps, excepting that with nitrogen, air is brought in through vent 16, providing more efficient evacuation of the processing fluids through drain 23. Apparatus 10 will not operate until door 14 is closed and locked with locking switch 42. The speeds at which the semiconductor wafers are processed are controlled by the RPM controls 43 and 45. Rinse Timer/RPM control 43 controls the speeds during the liquid processing steps and Dry Timer/RPM control 45 controls the speeds during the drying steps.

In operation, semiconductor wafers are placed in carrier 38 which is inserted into support members 26 of rotor 15. Upon closing door 14, locking switch 42 allows the apparatus 10 to be started by turning power switch 66 on and activating start/stop switch 68 as shown in FIG. 1. Rinse timer/RPM unit 43 provides the proper time and speed for liquid portion of processing of the semiconductor wafers. During the rinse cycle, various liquids are dispensed through spray member 33 for the cleaning and processing of the semiconductor wafers. The rinse cycle is determined to be completed by the monitoring of the rinse water at drain 23 with D.I. resistivity meter 40, and automatically switches to the dry cycle when the resistivity attains a predetermined number. Rinsing is aided by air flow into tub 12 through vent 16 when the resistivity of the rinse water is determined to be approximately that of the water dispersed from spray member 33, then the dry timer/RPM unit 45 is activated automatically. During the drying cycle, nitrogen is heated by heat element 37 in spray member 35 and is applied to the revolving semiconductor wafers at a sufficient pressure that outside air is not drawn in through vent 16 as is the case during the rinse cycle. The entire processing is easily viewed through window 8. Because the semiconductor wafers and carrier 38 are not generally the exact same weight and by construction carrier 38 rotates slightly off center so that at high RPM's the semiconductor wafers are held in the carrier 38 by centrifugal force. Shock absorbers 17 are necessary to eliminate vibrational energies from being transferred to the work surface on which apparatus 10 is resting. Rotor 15 rotates about a substantially horizontal axis. The axis of rotation ranges from 1° to 89° and 91° to 179° and their reciprocal angles. The preferred angle of axle 18 is in the range of 75° to 85°, being approximately 10° above the horizontal.

While particular embodiments of the present invention have been shown and described, it is apparent that change and modifications may be made without departing from the spirit and scope of this invention in its broader aspects.

What is claimed is:

1. An apparatus for processing semiconductor wafers and glass photomask plates comprising:

a frame;

said frame containing a tub means and a drive means;

an axle means having a first end portion protruding through the center of a first end of said tub means by a seal and bearing means to prevent the escape of processing fluids; said first end portion of said axle means having a rotor means; said axle means having a second end portion;

said second end portion of said axle means having a pulley means wherein said pulley means is connected to said drive means for rotating said axle and said rotor means;

said axle means and said tub means positioned at an angle slightly greater than horizontal so that said rotor means rotates substantially about a horizontal axis without interference from said tub means;

said rotor means having a plurality of support means for receiving a carrier containing said semiconductor wafers; a support rod means connected to said rotor means and parallel to said support means for retaining said semiconductor wafers in said carrier in the inverted position at low RPM's;

said tub means having a plurality of spray member means on the upper portion of said tub means for spraying fluids for processing of said semiconductor wafers;

a drain means within the lower portion of said tub means for the removal of said processing fluids;

said tub means open at a second end opposite of said rotor means to permit easy access to said carrier containing said semiconductor wafers;

a closure means;

said closure means having an open position and a closed position;

said closure means affixed to said frame in a manner that in said closed position said closure means contacts said second end of said tub means providing a positive seal retaining all said processing fluids within said tub means;

said closure means having a vent means in the upper portion of said closure means for providing air flow into said tub means when said rotor means is operating at high RPM's aiding in the removal of said processing fluids through said drain means after the processing of semiconductor wafers.

2. An apparatus according to claim 1 wherein said tub means is made from the group consisting of stainless steel, polypropylene, and polyethylene.

3. An apparatus according to claim 1 wherein said spray means is provided with a heating means to heat said processing fluids prior to their application to said semiconductor wafers.

4. An apparatus according to claim 1 wherein said angle of said axle is in the range from 5° and 89°.

5. An apparatus according to claim 1 wherein said angle of said axle is in the range from 91° to 179°.

6. An apparatus according to claim 1 wherein said angle of said axle is in the range from 181° to 269°.

7. An apparatus according to claim 1 wherein said angle of said axle is in the range from 271° to 359°.

8. An apparatus according to claim 1 wherein said angle of said axle is in the range from 60° to 85°.

9. An apparatus according to claim 1 wherein said angle of said axle is 80°.

10. An apparatus according to claim 1 wherein said drain means is provided with a resistivity monitor means to determine when semiconductor wafers have been thoroughly rinsed and automatically switches from said rinse cycle to a dry cycle.

11. An apparatus according to claim 1 wherein said support rod means has a plastic coating.

12. An apparatus according to claim 1 wherein said support rod means is eliminated.

13. An apparatus for processing semiconductor wafers and glass photomask plates comprising:

a frame;

said frame containing a tub means and a drive means;

an axle means having a first end portion protruding through the center of a first end of said tub means by a seal and bearing means to prevent the escape of processing fluids; said first end portion of said axle means having a rotor means; said axle means having a second end portion;

said second end portion of said axle means having a pulley means wherein said pulley means is connected to said drive means for rotating said axle and said rotor means;

said axle means and said tub means positioned at an angle slightly greater than horizontal so that said rotor means rotates substantially about a horizontal axis without interference from said tub means;

said rotor means having a plurality of support means for receiving a carrier containing said semiconductor wafers;

said support means having a first and a second end;

said first end of said support means connected to said rotor;

said second end of said support means connected to a support ring for providing additional stability for supporting said carrier; said rotor means having a support end means parallel to said support means for retaining said semiconductor wafers in said carrier in the inverted position at low RPM's;

said support rod means having a first and a second end;

said first end of said support rod means connected to said rotor;

said second end of said support rod means connected to said support ring providing additional support for said carrier; said tub means having a plurality of spray member means on the upper portion of said tub means for spraying fluids for processing of said semiconductor wafers;

a drain means within the lower portion of said tub means for the removal of said processing fluids;

said tub means open at a second end opposite of said rotor means to permit easy access to said carrier containing said semiconductor wafers;

a closure means;

said closure means having an open position and a closed position;

said closure means affixed to said frame in a manner that in said closed position said closure means contacts said second end of said tub means providing a positive seal retaining all said processing fluids within said tub means;

said closure means having a vent means in the upper portion of said closure means for providing air flow into said tub means when said rotor means is operating at high RPM's aiding in the removal of said processing fluids through said drain means after the processing of semiconductor wafers.

14. An apparatus according to claim 13 wherein said tub means is made from the group consisting of stainless steel, polypropylene, and polyethylene.

15. An apparatus according to claim 13 wherein said spray means is provided with a heating means to heat said processing fluids prior to their application to said semiconductor wafers.

16. An apparatus according to claim 13 wherein said angle of said axle is in the range from 5° to 89°.

17. An apparatus according to claim 13 wherein said angle of said axle is in the range from 91° to 179°.

18. An apparatus according to claim 13 wherein said angle of said axle is in the range from 181° to 269°.

19. An apparatus according to claim 13 wherein said angle of said axle is in the range from 271° to 359°.

20. An apparatus according to claim 13 wherein said angle of said axle is in the range from 60° to 85°.

21. An apparatus according to claim 13 wherein said angle of said axle is 80°.

22. An apparatus according to claim 13 wherein said drain means is provided with a resistivity monitor means to determine when semiconductor wafers have been thoroughly rinsed and automatically switches from said rinse cycle to a dry cycle.

23. An apparatus according to claim 13 wherein said support rod means has a plastic coating.

24. An apparatus according to claim 23 wherein said plastic coating is a material selected from the group consisting of polypropylene, polyethylene, polyethylene chloride or A.B.S.

* * * * *